United States Patent [19]

Hug

[11] Patent Number: 4,517,705

[45] Date of Patent: May 21, 1985

[54] SUCTION DEVICE FOR CLEANING TEXTILE FLOOR COVERINGS

[75] Inventor: Nikolaus Hug, Romanshorn, Switzerland

[73] Assignee: Düpro AG, Romanshorn, Switzerland

[21] Appl. No.: 500,568

[22] Filed: Jun. 2, 1983

[30] Foreign Application Priority Data

Jun. 2, 1982 [DE] Fed. Rep. of Germany ..... 3220644

[51] Int. Cl.[3] ..... A47L 5/30

[52] U.S. Cl. ..... 15/351; 15/412

[58] Field of Search ..... 15/350, 351, 412, 377

[56] References Cited

U.S. PATENT DOCUMENTS

| | | | |
|---|---|---|---|
| 2,867,833 | 1/1959 | Duff | 15/350 X |
| 3,126,570 | 3/1964 | Green | 15/351 X |
| 3,218,783 | 11/1965 | Ripple | 15/350 X |
| 4,171,553 | 10/1979 | Stein | 15/350 |
| 4,373,228 | 2/1983 | Dyson | 15/350 |
| 4,376,322 | 3/1983 | Lockhart et al. | 15/351 X |

FOREIGN PATENT DOCUMENTS

| | | | |
|---|---|---|---|
| 1453075 | 2/1969 | Fed. Rep. of Germany | 15/350 |

*Primary Examiner*—Chris K. Moore

*Attorney, Agent, or Firm*—Kenyon & Kenyon

[57] ABSTRACT

A suction device for cleaning textile floor coverings comprising a base member, a central housing, and a cover. A brushing device is detachably mounted closely adjacent to the base member. The base member has a tubular stub receiving a flexibly supported suction air connector sleeve of the brushing device. The dust chamber is located in the central housing and a dust air canal located within the housing of the suction device connects the tubular stub with the dust chamber. The suction blower and at least a portion of the electrical and/or electronic components are located in the base member resulting in a low center of gravity for the unit. The closely adjacent detachable mounting of the brushing device to the suction device avoids long vacuum hose and long electrical lines connecting the suction device to the brushing device.

35 Claims, 7 Drawing Figures

SUCTION DEVICE FOR CLEANING TEXTILE FLOOR COVERINGS

FIELD OF INVENTION

This invention relates to a suction device for cleaning textile floor coverings.

BACKGROUND OF THE INVENTION

Heavily soiled floor coverings, especially the carpeted floors of business premises having considerable public traffic, can usually no longer be cleaned satisfactorily with only a vacuum cleaner because very often the dirt penetrates into the textile floor covering so deeply that it can be removed only by an additional mechanical cleaning process, for instance, by brushing the floor covering. The brushing devices usually employed for this purpose have a motor-driven cylindrical brush which is rotatably supported in a suction opening of the equipment. The bristle lining of this brush engages the textile floor covering with the individual bristles, whereby the dirt is separated and then is seized and carried away by a suction air stream which flows in through the suction opening of the equipment. To this end, the brush device is connected detachably to a known suction device or vacuum cleaner of the above-mentioned type.

In the known suction devices or vacuum cleaners, the electrical and/or electronic components are accommodated in the cover and the handle serves only for moving the suction device about. The handle is not used for gliding the cleaning device, for which purpose an additional manual guide tube is provided. This additional manual guide tube is disposed between the cleaning device and a suction hose having the plug-in sleeve. The consequence of this arrangement of the electrical and/or electronic components is that the center of gravity of the suction device is relatively far above the floor and the distance from the cleaning device is relatively great, whereby an electric cable and the suction hose must be correspondingly long. This makes the equipment more expensive. A significant disadvantage of this prior art arrangement is that cleaning with such a suction device and the associated cleaning device is difficult, since the suction device is easily upset if it is dragged via the suction hose when the manual guide tube is moved back and forth and the suction device is not at the same time held by the handle. In addition, the long lines are in the way, since they must frequently be cleared out of the path of motion of the cleaning device. Another disadvantage is that the cleaning device often cannot be moved back and forth easily via the manual guide tube because of the connected suction hose.

Tank type vacuum cleaners with a power driven nozzle have been commonly used to clean the floor coverings of business premises. The present invention provides an upright vacuum cleaner which may be provided with a power brush and is suitable for cleaning floor coverings in heavy traffic areas without the attendant disadvantages of tank type vacuum cleaners which have been hereinbefore discussed.

OBJECT OF THE INVENTION

It is therefore an object of the present invention to provide a suction and cleaning device wherein the electrical and air-conduction connections are made as short as possible without impairment of the dust-tight accommodation of the dust filter bag and the electrical and/or electronic components.

These and other objects of the present invention will become apparent from the following description and claims in conjunction with the drawings.

SUMMARY OF THE INVENTION

According to the present invention, the base of the suction device is immediately adjacent to the cleaning device, so that the electrical and air-conduction connections are kept extremely short whereby no electric lines and no suction hose interfere with the work and drag on the floor. In addition, the center of gravity of the suction device is located close to the floor or, in the shut-down position, directly above the cleaning device. Therefore, the equipment unit according to the present invention, comprising the suction device and the cleaning device, is of very compact design and can easily be handled by the equipment handle serving as the guide handle. Danger of tilting is substantially avoided. In addition, the electrical and electronic components are accommodated in the base, protected from dusty air.

DESCRIPTION OF THE PREFERRED EMBODIMENTS

Figure 1:
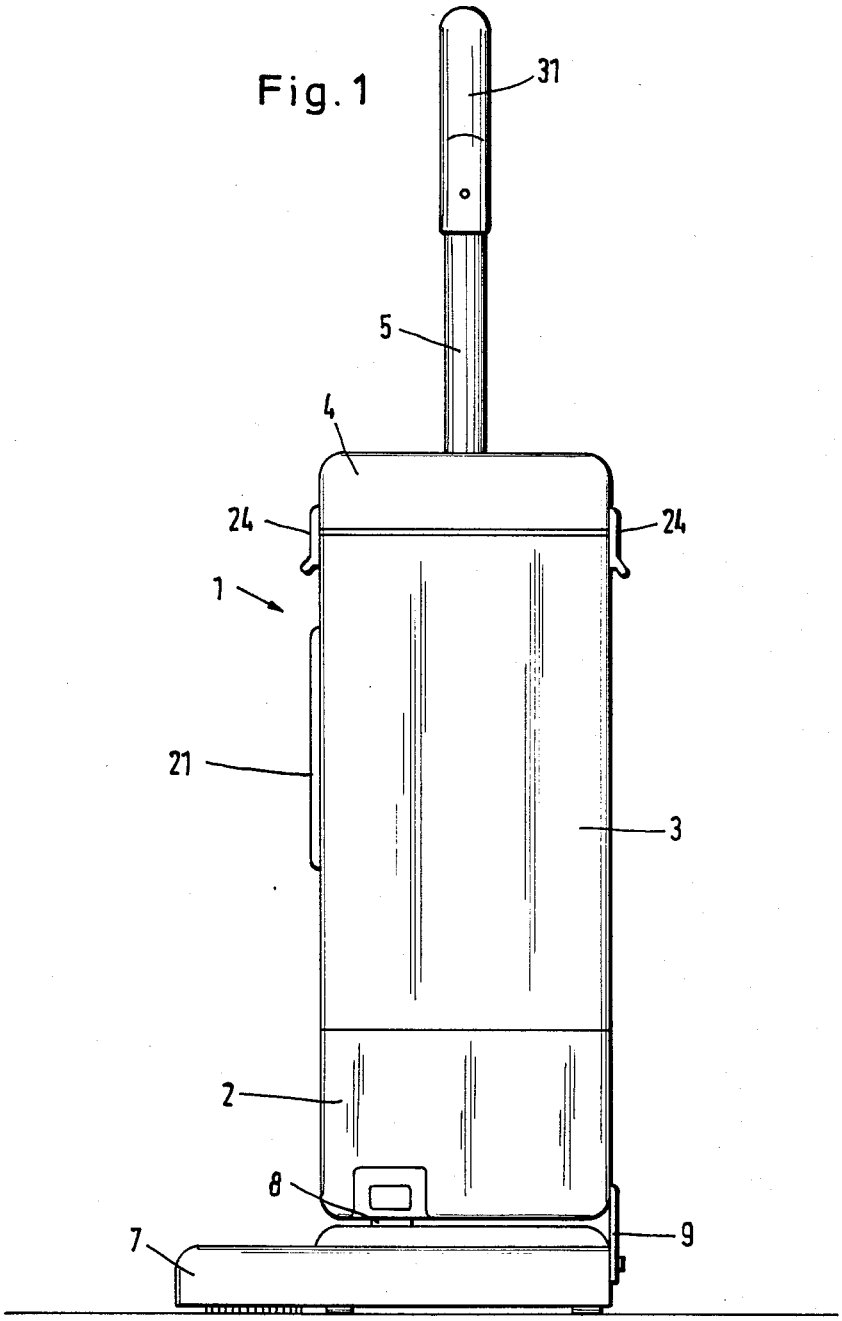
FIG. 1 is a schematic front view of a suction device with a suction brush cleaning device according to the present invention.

FIGS. 1 to 7 show a suction device 1 which comprises a base 2, with a central housing part 3 supported thereon. Central housing 3 includes a dust receiving chamber 13 (FIG. 2) and a cover 4, and has connected to its back side a guide handle 5 which extends above the height of the central housing 3 and the cover 4 of the housing 3. The base 2, the central housing part 3 and the cover 4 may each be designed cup-shaped with each having the same outer contour and are arranged so that together they form a housing of the suction device 1 with rear, front and side walls 35 to 38. The central housing part 3 has a bottom 20 which is designed as an intermediate plate and has a circular plug rim 41 which extends downward and is offset inward by the thickness of the side walls and by which the central part 3 is plugged into the base 2. The cover 4 is fastened to the central part 3 by locking catches 24. The guide handle 5, which is suitably tubular, extends over the entire length of the central part 3 and the cover 4 and is preferably fastened to both, whereby it provides a very secure hold on the suction device 1. Therefore, the suction device 1 is easy to guide by the guide handle 3. As is shown particularly in FIG. 3, handle parts 31 and 32 having handle openings 52 and 53 respectively are provided at the upper and lower end of the guide handle 5 for ease of handling the suction device 1. The handle parts 31, 32 each are provided with hooks 33 and 34 which may be made integrally with them and point in opposite directions. A line cord 29 may be wound onto hooks 33, 34 if the suction device 1 is not in use.

Figure 2:
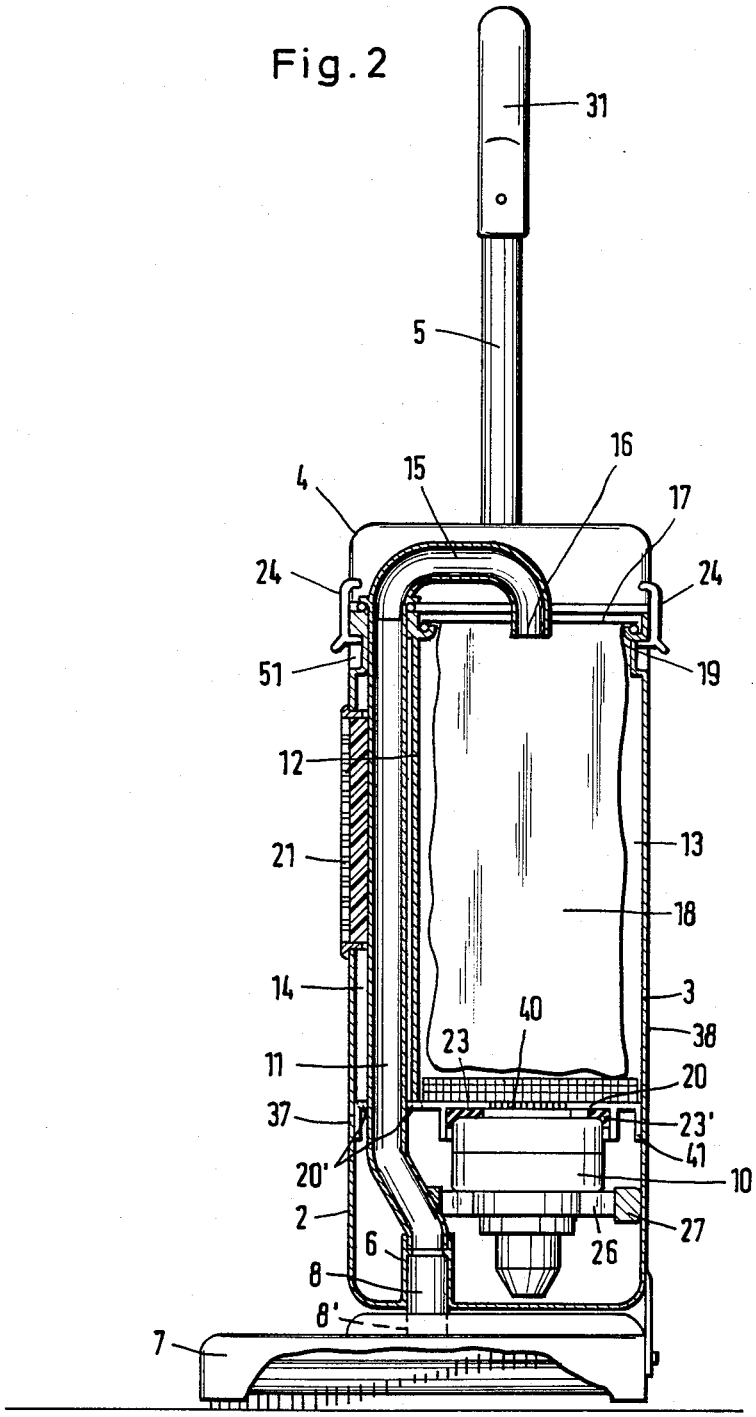
FIG. 2 is a schematic front elevation view, partly in section, of the suction device with the cleaning device of FIG. 1.

The suction device 1 is connected to a cleaning device designed as a brush device 7 which has a flexibly supported conical plug-in sleeve 8 extending into a suction stub 6 with a corresponding internal cone (FIG. 2). Thereby, the housing 2 to 4 can be swung into a tilted position relative to the brushing device 7, so that the brushing device always rests with its entire surface on the floor covering to be cleaned. In addition to this air-conducting and mechanically locking plug connection, a further support 9 is provided for the suction device between the brushing device 7 and the base 2. Support 9 is fastened to the base 2 and snapped onto the brushing device 7.

Figure 3:
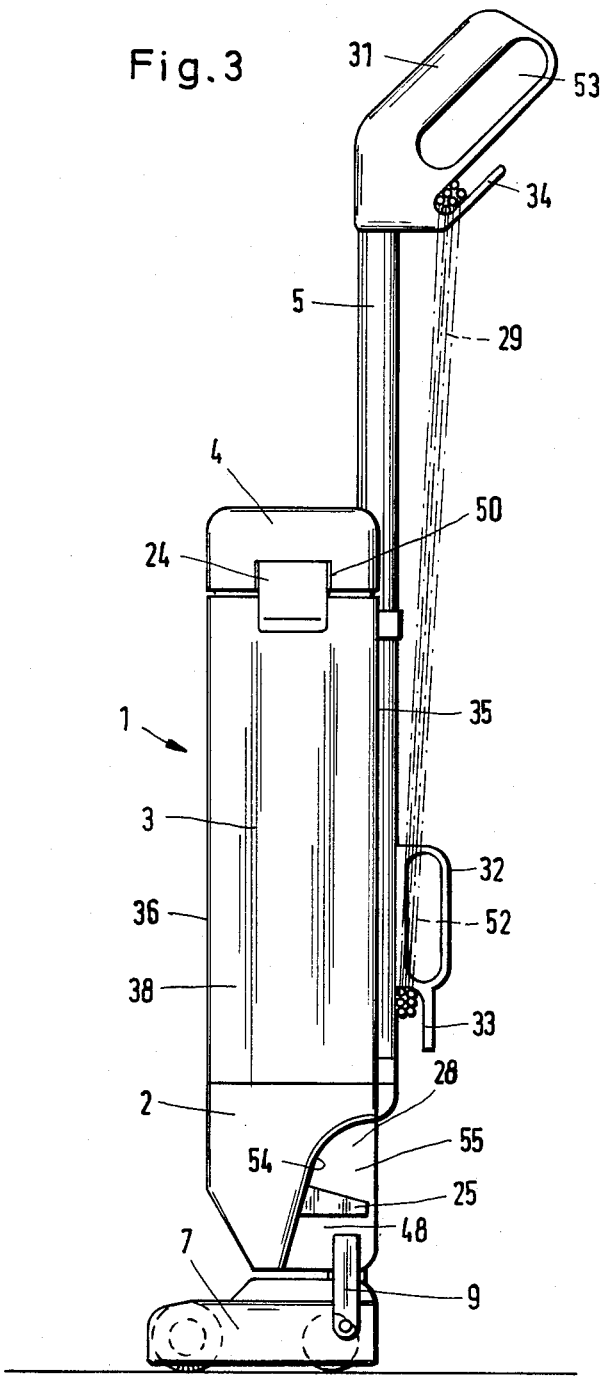
FIG. 3 is a schematic side view of the suction device with the cleaning device of FIG. 1.
Figure 4:
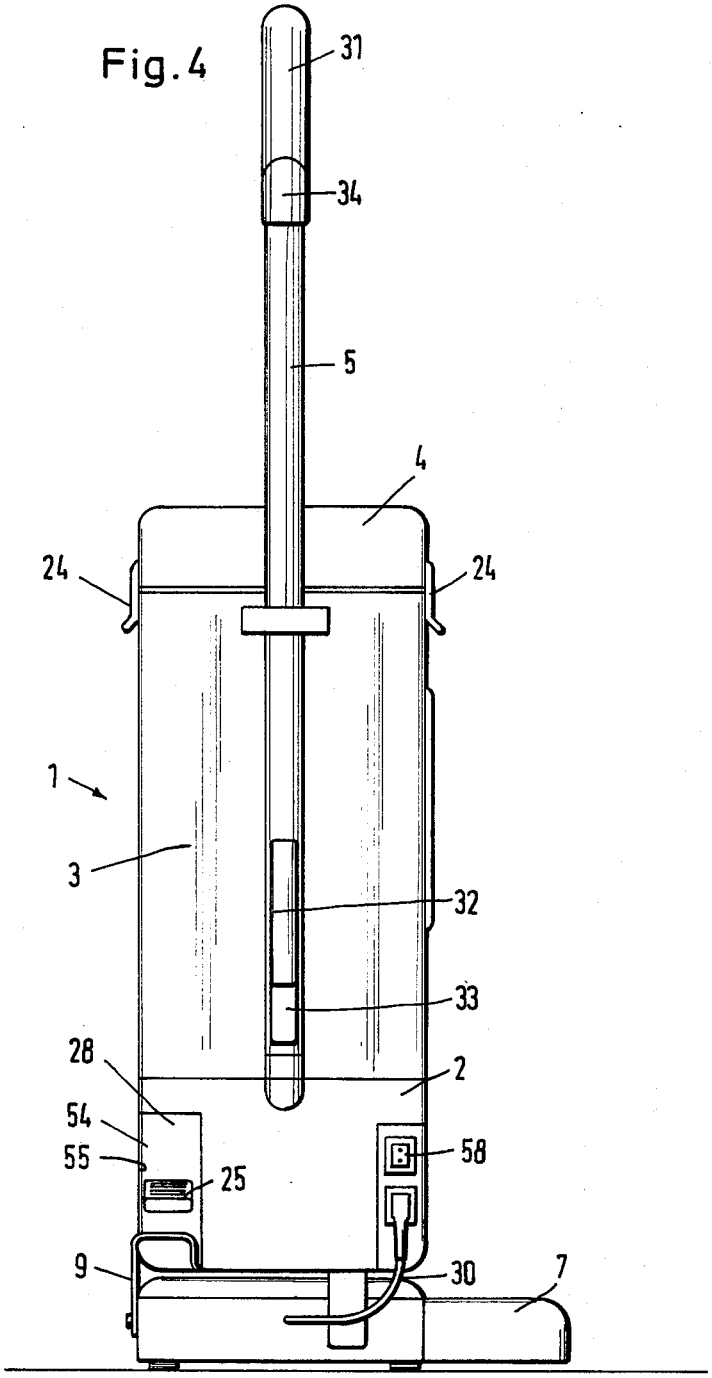
FIG. 4 is a rear view of the suction device with the cleaning device of FIG. 1.
Figure 5:
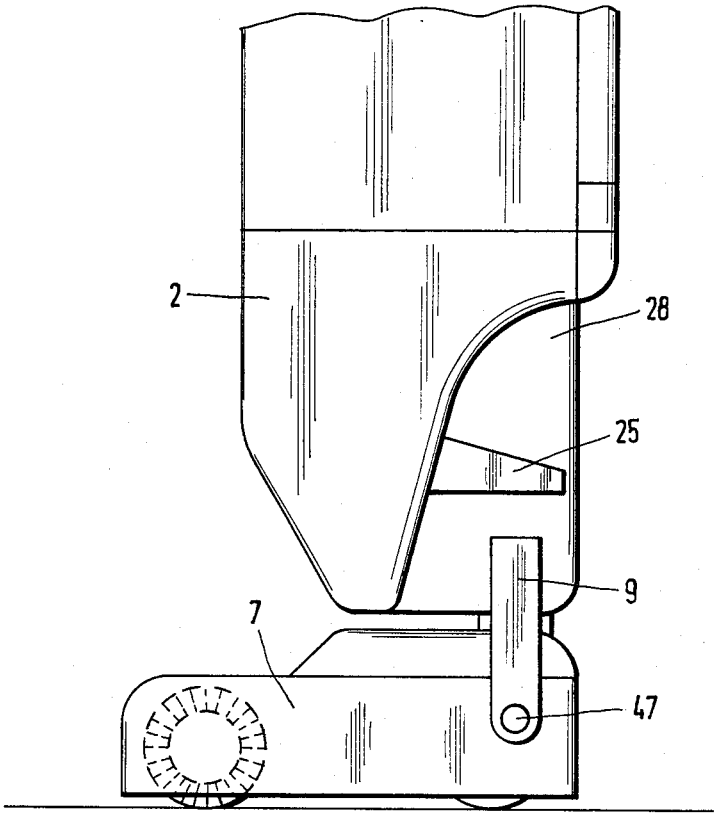
FIG. 5 is an enlarged schematic detail of the lower portion of FIG. 3 further illustrating the suction device with the cleaning device in accordance with the present invention.
Figure 6:
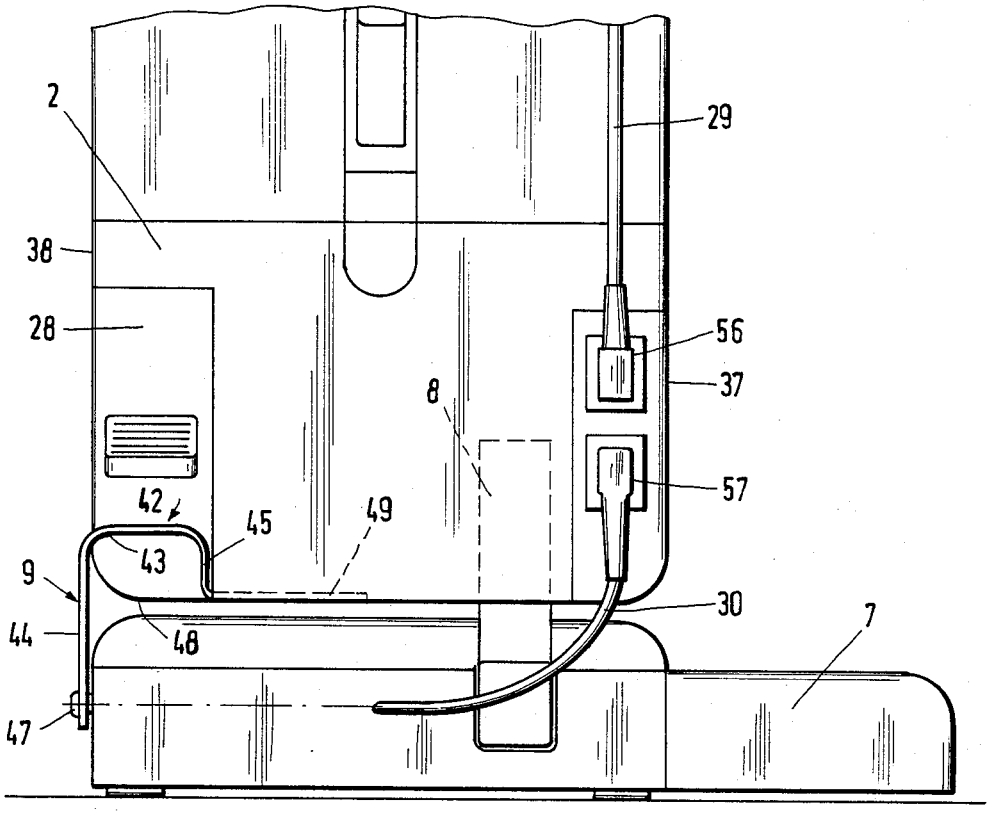
FIG. 6 is a schematic detail of the lower portion of FIG. 4.
Figure 7:
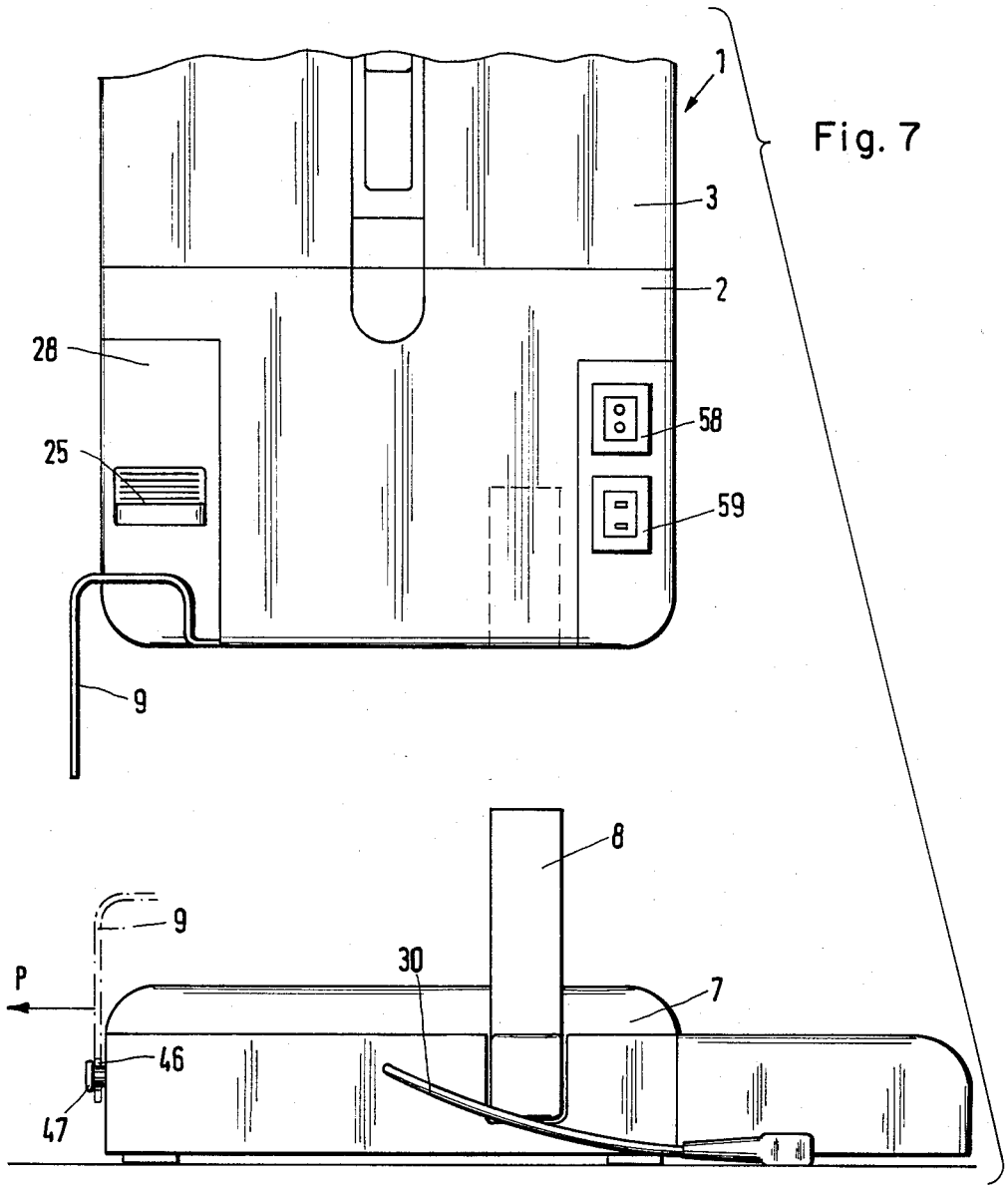
FIG. 7 is a schematic detail of the lower portion of FIG. 4 in which the suction device and the cleaning device of the present invention are separated from each other.

As is shown particularly in FIGS. 3 and 6, the strap support 9 comprises a strip of material and has a U-shaped central section 42, which extends with a cross piece 43 over the entire width of a receiving space 28 of the base 2. One U-leg 44 of the strap 9 is shorter than the other U-leg 45 and rests against the associated side wall 38 of the housing. The leg 44 has at the end a push-through opening 46 (FIG. 7) for receiving an associated support pin 47 of the brushing device 7, onto which it can be snapped. For separating the suction device 1 from the brushing device 7, this U-leg 44 must be pushed outward in the direction of the arrow P over the head of the support pin 47, whereby the snap connection is released and the suction device 1 can be lifted up by separation of the brushing device 7 and the base 2 (FIG. 7).

The other, longer U-leg 45 is angled-off outward at the height of a bottom 48 of the base 2 and forms with this angled-off section 49 a fastening strap, by which the strap 9 is fastened to the bottom 48 of base 2, for example, by cementing, welding or by screws.

Since the suction device 1 is fastened via its base 2 above and closely adjacent to the brushing device 7 by the strap 9, the suction device and the brushing device form an extremely compact equipment unit which is easy to handle and in which electric lines are extremely short. The air-conduction connection extends inside the suction device. Thereby, these parts on the one hand, are accommodated and protected and, on the other hand, do not interfere during cleaning operations with the brushing equipment and the suction device.

Dirt particles are loosened from the floor covering to be cleaned by the brushing device 7. The loosened dirt particles are suctioned via a suction air stream generated by a suction blower 10 through a suction opening of the plug sleeve 8 which is indicated in FIG. 2 by dashed lines 8' and leads to the underside of the brushing device 7. The plug sleeve 8 leads into the suction stub 6 of the base 2. A tubular dust air canal 11 is pushed in an air-tight manner onto the suction stub 6 so that the brushing device 7 or the canal 11 can be easily and quickly separated from the suction device 1 for replacements or removing cloggings or the like. The dust air tube 11 extends over the entire height of the housing 3. From the base 2, it first runs from the suction stub 6 outward at an angle up to the adjacent housing side wall 37, where it changes underneath the central housing bottom 20 into a tube section which is parallel to the longitudinal axis of the central housing 3.

In the central housing part 3, the dust air tube 11 runs inside the dust discharge space 13 with a constant small spacing from the side wall 37 of the housing 3. In the cover 4, which forms a deflection chamber 15 for the dust air tube 11, the dust air tube 11 is angled-off in U-fashion wherein it extends via a discharge stub 16 through a corresponding opening in a terminating plate 17 of dust filter bag 18. In the tube section 15 which, is curved in U-fashion, the dust filled air is deflected downward 180° and blown into a dust filter bag 18 which is located within the dust chamber 13 of central housing 3. The dust chamber 13 and the dust filter bag 18 [which is most suitably of corresponding size] have a large volume and are sealed at the top by the terminating plate 17. Terminating plate 17 rests on a circular support rim 19, which extends inward into the dust chamber 13, whereby the dust chamber 13 is also sealed at its top from the cover 4.

The purified air stream exists through the dust filter bag 18 and flows through the openings 40 of the bottom 20 of the central part 3 toward the motor-driven suction blower 10. From the suction blower 10, the air stream then enters the base part 2, from where it is transported through further openings 20' in the bottom 20 upward into the discharge space 14.

Discharge space 14 is separated from the dust chamber 13 by a vertical partition 12. Discharge space 14 is considerably narrower than the dust chamber 13 (FIG. 2) and suitably about twice as wide as the diameter of the dust air tube 11. Therefore, the dust chamber 13 is, on the one hand, extremely large, so that it can accommodate a dust filter bag 18 with a large capacity. On the other hand, however, the discharge space 14 is still sufficiently large so that the inflowing purified air can expand therein relatively greatly and can settle, so that it flows with a relatively low velocity and therefore, with little noise, through a discharge screen 21 in the housing wall 37 into the outside surrounding space.

The suction blower 10 is located in base 2 and is fastened at the height of its center of gravity in a clamp-like mounting 26 which is disposed in and secured against rotation by elastic support pockets 27 formed by lateral housing ribs. Accordingly, no additional mounting parts such as screws etc. are required.

The bottom 20 of the central part 3 surrounds with its outer plug rim 41 a cylindrical extension 23 of the same height which surrounds the suction blower 10 tightly with the interposition of an elastic sealing ring 23'. Thereby, the suction blower is axially fixed relative to the housing members 2 to 4, and a complete seal is obtained between the suction chamber 13 and the discharge space 14, in which overpressure and underpressure, respectively, prevails. The axes of the extension 23 and the suction blower 10 are substantially aligned with the longitudinal axis of the dust chamber 13. The length of the dust chamber 13 along its longitudinal axis is suitably about three-times greater than the longitudinal length of the base, which in turn is suitably about twice the longitudinal length of the cover 4. The axis of the plug sleeve 8 and the suction stub 6 lie approximately in the plane of the partition 12. The longitudinal axis of the dust air tube 11 is suitably located at about half the width between the partition 12 and the adjacent side wall 37.

For purposes of taking out and inserting the dust filter bag 18, the cover 4 must be removed from the central part 3. For this purpose, locking catches 24 are provided on both sides of the cover 4 as already mentioned. Locking catches 24 are hinged in associated depressions 50 of the side walls 37 and 38 (FIG. 3) and snap in the closed position of the cover 4 into corresponding detent openings 51 in the central part 3 (FIG. 2).

For switching the suction device 1 and the brushing device 7 on and off, a pedal 25 serving as a switch is arranged in the receiving space 28 of the base 2. Pedal 25 is in functional connection with the electrical and/or electronic components. The receiving space 28 is formed by recesses in the rear wall 35, open at the rim, and the adjacent side wall 38 and extends substantially over the entire height of the base 2. The receiving space 28 is tapered toward the top (FIG. 3) and has its largest lateral dimension at the bottom 48 of the base. The recess in the side wall 38 has, in the side view according to FIG. 3, approximately the form of half a parabola. The recess at the backside 35 has a rectangular outline (FIG. 4) and extends upward. The receiving space 28 is closed off by a front boundary wall 54 curved according to the contour of the recess in the side wall 38, and a boundary wall 55 which is paralled to the side walls 37 and 38. At about half the height of the front boundary wall 54, the pedal 25, which is pivoted in the interior of the base 2, extends into the receiving space 28 through an associated opening (not shown). The pedal 25 is wedge-shaped in the side view (FIG. 3) and is tapered in the direction toward the housing wall 35, whereby it can be operated easily. The pedal 25 is located in the receiving space 28 within the outer contour of the base 2. Thus, the pedal 25 does not interfere by extending outward beyond the housing of the suction device, but can nevertheless be reached with the tip of the foot without effort and be operated.

As already mentioned, the base 2 contains the generally known electrical and electronic components such as control, switching and protection devices and indicators such as indicator lamps for the suction device which display the respective operating conditions. These parts are accommodated perfectly protected from the effect of the dust filled air due to the protected arrangement within the housing and are connected to the brushing device 7 by only extremely short lines. The details of the construction of the housing device and the suction blower 10 may be readily provided by one skilled in the art.

Plugs 56 and 57 for a power cable 29 and a power connecting line from the suction brush 7 to the suction device 1 are associated respectively with outlets 58 and 59 (FIGS. 6 and 7) of the base part 2. The plugs 56, 57 can easily be pulled from outlets 58, 59 for separating the brushing device 7 from the suction device 1.

It will be appreciated that the location of the suction blower 10 and a substantial portion of the electrical and/or electronic components in the base 2 will result in the suction device of the invention having a low center of gravity. This substantially avoids any tendency of the device of the invention to tip. Due to the direct connection of the base 2 to the brush device 7, there are no troublesome long electrical lines or suction hoses. In addition, a very compact structural unit has been provided.

In the claims, the term electrical components will include electrical and/or electronic components.

The brushes of the brushing device 7 may be, e.g., of the motor-driven cylindrical type. The motor for driving the brushes would be located in the brushing device 7 with electrical power being provided by electrical cable 30. Other types of brush arrangements could be provided.

Although preferred embodiments of the present invention have been described in detail, it is contemplated that modifications may be made within the spirit and the scope of the invention.

What is claimed is:

1. In a suction device for cleaning textile floor coverings comprising a housing enclosing a dust chamber for receiving a dust filter bag, a cover detachably mounted on said housing in a sealed air-tight manner, a cleaning device for floor coverings having a flexibly supported suction air connector sleeve, said housing surrounding a tubular stub for receiving said suction air connector sleeve, electrical components disposed in said housing, a dust air canal connecting said tubular stub and said dust chamber, the improvement comprising:

a base member forming part of said housing wherein said base member is in fluid communication with said dust chamber and houses at least a portion of said electrical components and at least a portion of said dust air canal;

support member means for detachably and supportably connecting said base member to said cleaning device; and said base member includes said tubular stub detachably receiving said suction air connector sleeve of said cleaning device;

whereby said cleaning device is easily removable from said base member.

2. A suction device as recited in claim 1 wherein said housing includes a central housing member detachably connected to said base member.

3. A suction device as recited in claim 2 wherein said dust chamber is enclosed in said central housing member.

4. A suction device as recited in claim 3 wherein an air discharge chamber is located in said central housing member.

5. A suction device as recited in claim 4 wherein a partion wall extends substantially the entire longitudinal height of said central housing member and is positioned between said dust chamber and said air discharge chamber.

6. A suction device as recited in claim 4 wherein the width of said air discharge chamber is substantially narrower than the width of said dust chamber and wherein said dust air canal is a tubular canal and said width of said air discharge chamber is about twice the diameter of said tubular dust air canal.

7. A suction device as recited in claim 4 wherein said air discharge chamber terminates in a screened discharge opening.

8. A suction device as recited in claim 4 wherein said cover is detachably mounted on said central housing member; said dust air canal extends upward through said air discharge chamber and into said cover; and said dust air canal within said cover curves downward and is connected in fluid communication with said dust chamber.

9. A suction device as recited in claim 3 wherein said cover is detachably mounted on said central housing member; a deflection chamber having a first end and a second end is located in said cover; and wherein the first end of said deflection chamber is connected in fluid communication with said dust air canal and said second end of said deflection chamber is connected in fluid communication with said dust chamber.

10. A suction device as recited in claim 9 wherein said dust chamber is sealed from said cover by a termination plate.

11. A suction device as recited in claim 9 wherein a circular rim is mounted on said dust chamber at the top end of said dust chamber near said cover; a termination plate rests on said rim for sealing said dust chamber from said cover; and said second end of said deflection chamber penetrates said termination plate for fluid communication with said dust chamber.

12. A suction device as recited in claim 3 wherein said cover is detachably mounted on said central housing member and a guide handle is joined to the rear wall of said central housing member and extends along the length of the wall of said central housing member and the cover.

13. A suction device as recited in claim 12 wherein said guide handle includes at least a first handle part located above said cover and a second handle part which is joined to the lower half of said central housing.

14. A suction device as recited in claim 12 wherein said guide handle has mounted thereon at least two spaced apart hooks arranged a selected distance from one another for the winding up of a power cable.

15. A suction device as recited in claim 3 wherein said cover is detachably mounted to said central housing member, and said base member, said central housing member and said cover have approximately the same outside contour whereby aligned outer housing walls are formed.

16. A suction device as recited in claim 2 wherein said central housing member has a bottom wall including a circular plug rim extending downward from said bottom wall wherein said circular plug rim plugs into said base member whereby said central housing member is joined to said base member.

17. A suction device as recited in claim 16 wherein said central housing bottom wall includes an annular extension member positioned within said circular plug rim which extends downward for receiving a suction blower.

18. A suction device as recited in claim 17 wherein said suction blower is located in said base member and said suction blower is secured in the axial direction by the interposition of an elastic seal between said annular extension member and said suction blower.

19. A suction device as recited in claim 18 wherein the axis of said annular extension member is approximately aligned with the longitudinal axis of said dust chamber.

20. A suction device as recited in claim 18 wherein said base member includes mounting means supporting said suction blower at about the height of the center of gravity of the suction blower.

21. A suction device as recited in claim 20 wherein elastic support means joined to the side walls of said base member hold said mounting means secure against rotation.

22. A suction device as recited in claim 1 wherein said support member means has the form of a strap detachably connecting said cleaning device to said base member.

23. A suction device as recited in claim 22 wherein said base member has a bottom wall and said strap has a first leg and a second leg wherein the first leg of said strap is fixedly fastened to said bottom wall.

24. A suction device as recited in claim 23 wherein the cleaning device has a detent member for receiving said strap and the second end of said strap is detachably joined to said detent member.

25. A suction device as recited in claim 24 wherein said base member has an open receiving space and at least a portion of the first leg of said strap is located in said receiving space.

26. A suction device as recited in claim 1 wherein said base member has a receiving space formed by recesses of adjacent walls of said base member.

27. A suction device as recited in claim 26 wherein said receiving space extends substantially over the entire height of said base.

28. A suction device as recited in claim 27 wherein said receiving space is tapered in approximately a V-fashion toward the central housing member as viewed from the side.

29. A suction device as recited in claim 28 wherein said receiving space has a rectangular rear outline.

30. A suction device as recited in claim 27 wherein said receiving space has a front boundry wall which joins the side wall of the base member approximately at right angles and a lateral wall which joins the rear wall of the base member approximately at right angles.

31. A suction device as recited in claim 30 wherein a switching lever is disposed within said receiving space and said switching lever protrudes through said forward boundry wall toward the rear wall of said base member.

32. A suction device as recited in claim 31 wherein said switching lever has the form of a foot pedal.

33. A suction device as recited in claim 32 wherein said foot pedal is located within the contours of the outer housing walls of said base.

34. A suction device as recited in claim 31 wherein means are provided within said base for functionally connecting said switching lever to said electrical components.

35. A suction device as recited in claim 1 wherein said base member has a first plug outlet for receiving a plug electrically connected to a main power line cable and a second plug outlet for receiving a plug electrically connected to a power line cable connected to said cleaning device.

* * * * *